US006082144A

United States Patent [19]

Jencks et al.

[11] Patent Number: 6,082,144

[45] Date of Patent: Jul. 4, 2000

[54] CIRCULAR WARP KNIT PACKING MATERIAL

[75] Inventors: Andrew D. Jencks, Seekonk, Mass.; Vladimir Akopian, East Providence, R.I.

[73] Assignee: New England Overseas Corporation, Pawtucket, R.I.

[21] Appl. No.: 09/002,417

[22] Filed: Jan. 2, 1998

[51] Int. Cl.[7] ..... D04B 25/02

[52] U.S. Cl. ..... 66/170; 66/192; 66/195; 66/202

[58] Field of Search ..... 66/192, 190, 170, 66/81, 80, 94, 79, 195, 202; 87/3, 9; 442/312, 313, 314

[56] References Cited

U.S. PATENT DOCUMENTS

| | | | |
|---|---|---|---|
| 239,287 | 3/1881 | Winana | 277/537 |
| 1,771,912 | 7/1930 | Blaisdell | 87/6 |
| 3,124,032 | 3/1964 | Webster et al. | 87/1 |
| 4,123,830 | 11/1978 | Matsuda et al. | 66/81 |
| 4,838,043 | 6/1989 | Jencks | 66/170 |
| 4,977,759 | 12/1990 | Jencks | 66/81 |
| 5,512,709 | 4/1996 | Jencks | 174/35 |
| 5,603,514 | 2/1997 | Jencks | 277/230 |

*Primary Examiner*—Danny Worrell

*Attorney, Agent, or Firm*—Barlow, Josephs & Holmes, Ltd.

[57] ABSTRACT

A packing material is constructed with an inner core and an outer circular sheath having compressible and extendible filler yarns which help reduce keystoning of the packing material when bent around corners or curved surfaces. More specifically, the sheath is formed from a plurality of base yarns and a plurality of filler yarns, wherein the yarns are either knit by a circular warp-knitting method or braided. The filler yarns are positioned at predetermined locations within the sheath structure and configured in their construction so as to give the sheath a predetermined geometric configuration when knitted. In the preferred construction, four filler yarns are arranged in a square configuration to give the packing material a generally square configuration. The key feature of the present invention is that the filler yarns comprise yarns which are extendible and compressible in a longitudinal direction. The filler yarns preferably comprise a chain-stitched knit yarn construction which is naturally extendible and compressible in a longitudinal direction. The knit filler yarns are introduced into the warp in partially extended condition, i.e. under back tension, and will thereafter be at least partially compressible and extendible in a longitudinal direction in the finished packing material. In this regard, the sheath is at least partially longitudinally compressible along an inner radius when the packing material is bent around a curved surface. The resulting effect of the compression along the inner radius is a reduction of "keystoning" of the packing material.

4 Claims, 3 Drawing Sheets

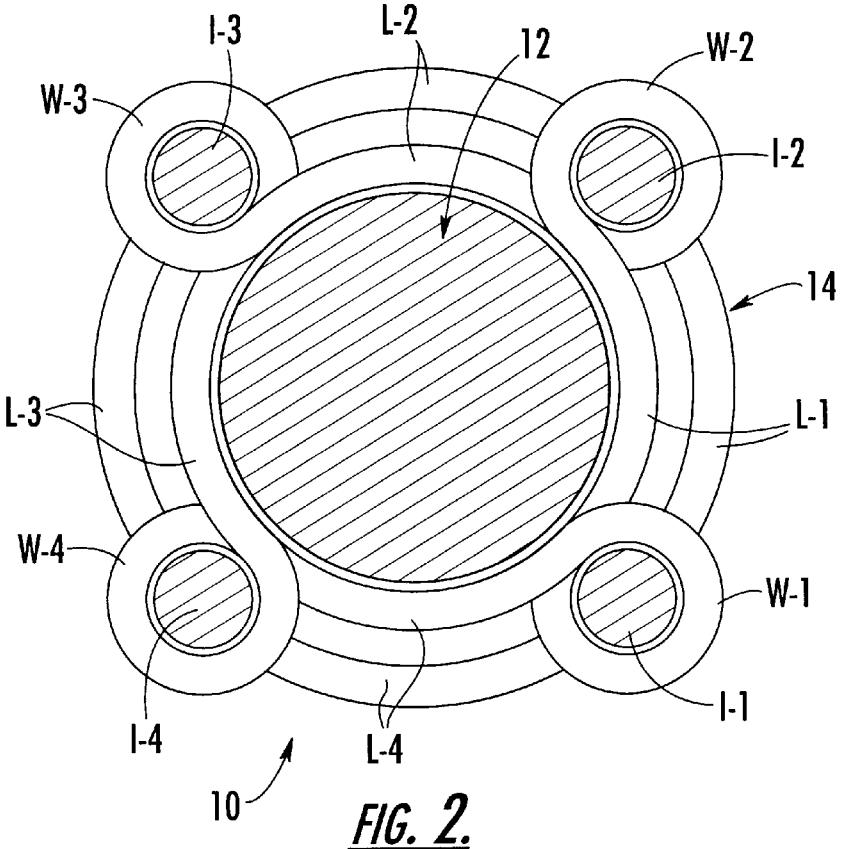
FIG. 2.
FIG. 3.
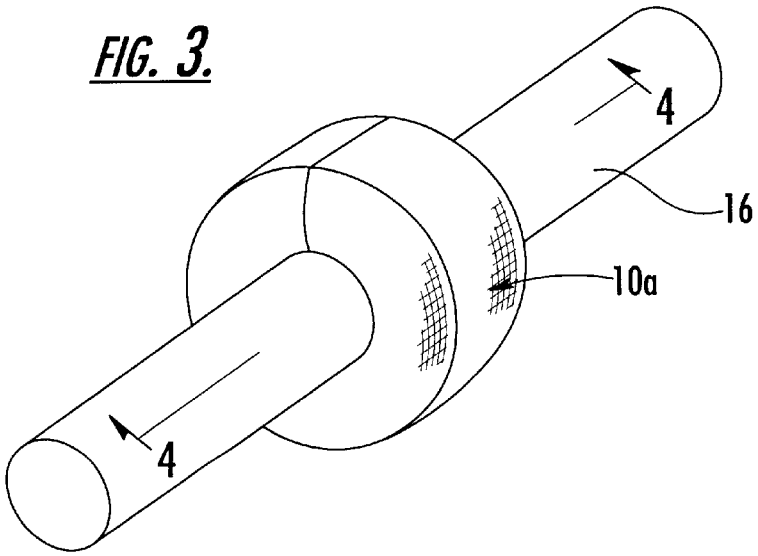

CIRCULAR WARP KNIT PACKING MATERIAL

BACKGROUND AND SUMMARY OF THE INVENTION

The instant invention relates to mechanical packing materials for controlling leakage around shafts and other cylindrical or curved surfaces, and more particularly to a packing material which is formed using previously knit interlace or filler yarns which will naturally expand and compress in a longitudinal direction when the packing is wrapped around a shaft, and thus reduce keystoning of the packing material.

In general, mechanical packings are usually manufactured in relatively long coils of packing material of square or rectangular cross-section from which many individual lengths can be cut to form packing rings. Conventionally, a packing is formed by cutting several lengths from the coil of material, each length then being formed into a ring with abutting ends and installed around a shaft or around another cylindrical object. One longstanding drawback of existing packing materials is a deformation, i.e. bunching or "keystoning"of the packing material when it is bent around corners, or around a shaft. "Keystoning" is generally defined as a bunching of material along the inner radius of a bend when the material is wrapped around a corner or curved surface. The extra material on the inner radius of the corner bunches up and creates wrinkles at the corner which in turn create pressure points, and reduce facing contact with the surrounding structures. Although there have been many attempts to reduce keystoning by changing the initial shape of square or rectangular packings to a trapezoidal formation so that keystoning is reduced when wrapped, the problem still exists and still reduces the effective life of the existing packing materials.

The instant invention provides an improved packing material of square, rectangular or other geometric construction, which reduces keystoning of the packing material. In particular, the improved packing material comprises an elongate cord-like construction having an inner core and an outer sheath that is constructed from a plurality of base yarns and a plurality of interlace or filler yarns. The inner core can comprise a variety of different types and constructions of varying materials including bundles of straight yarns, knit bundles of yarns, knit or braided cords, etc. The outer sheath is knit or braided around the core in a tubular configuration wherein the base yarns comprise yarn compositions which are typically used to form packing materials, such as Teflon, glass, Kevlar, graphite, etc. As will be further described herein, it is known in both braiding and knitting techniques to insert "filler" yarns within the construction to achieve certain desired characteristics to the cords. In the braiding art, such yarns are typically referred to as "filler" yarns, and in the warp-knitting art, the yarns are typically referred to as "interlace or inlaid" yarns. To simplify further discussion of the sheath construction, it is to be understood by the reader that the term "filler" yarn will be used interchangeably with respect to both knitting and braiding techniques, and that the term "filler" is intended to cover either an interlace yarn in knitting or a filler yarn in braiding.

Continuing on with the sheath structure, the filler yarns are selectively positioned at predetermined locations within the sheath structure so as to give the sheath a predetermined geometric configuration when formed. In the preferred construction, four filler yarns are arranged in a square configuration to give the packing material a generally square configuration. The key feature of the present invention is that the filler yarns comprise natural yarn materials or yarn constructions which are naturally extendible and compressible in a longitudinal direction. In this regard, the filler yarns preferably comprise a chain stitched knit yarn construction which is naturally extendible and compressible in a longitudinal direction. The previously knit filler yarns are introduced into the knit or braided sheath structure in partially extended condition, i.e. under back tension, and will thereafter be at least partially compressible and extendible in a longitudinal direction in the finished packing material. In this regard, the sheath is at least partially longitudinally compressible along an inner radius when the packing material is bent around a curved surface. The resulting effect of the use of the previously knit filler yarns is a noticeable reduction of "keystoning" of the packing material along the inner radius. Although it is preferred to utilize the previously knit filler yarns on all corners of the packing, it is to be understood that the filler yarns are really only required on the innermost corners because keystoning is only a significant problem on the inner radius of a packing ring.

Accordingly, among the objects of the instant invention are: the provision of a packing construction which reduces "keystoning" of the packing when wrapped around corners or curved surfaces; the provision of a packing material having a sheath including filler yarns which are naturally compressible and extendible in a longitudinal direction; the provision of a packing material having a circular warp-knit or braided sheath including filler yarns which are naturally compressible and extendible in a longitudinal direction; and the provision of such a packing material wherein the compressible yarns preferably comprise knit yarn constructions.

Other objects, features and advantages of the invention shall become apparent as the description thereof proceeds when considered in connection with the accompanying illustrative drawings.

DESCRIPTION OF THE DRAWINGS

In the drawing figures which illustrate the best modes presently contemplated for carrying out the present invention:

FIG. 2 is a cross-sectional view of the packing material as taken along line 2—2 in FIG. 1;

FIG. 3 is a perspective view of a length of knit packing material wrapped in a packing ring around a cylindrical shaft;

DESCRIPTION OF THE PREFERRED EMBODIMENT

Figure 1:
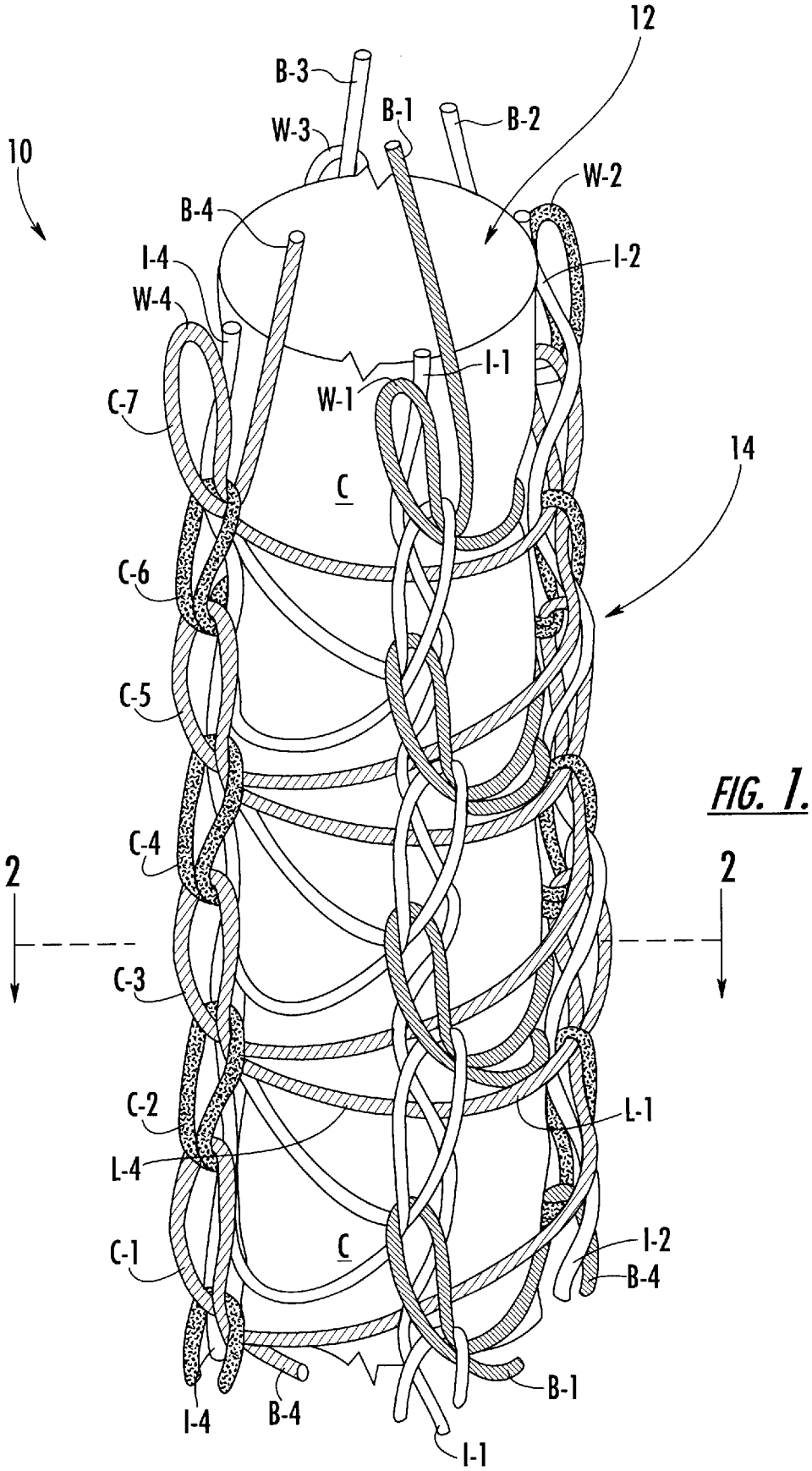
FIG. 1 is a perspective view of a length of knit packing material constructed in accordance with the teachings of the present invention.

Referring now to the drawings, the packing material of the instant invention is illustrated and generally indicated at 10 in FIGS. 1–4. As will hereinafter be more fully described, the instant invention provides an improved packing material of square, rectangular, triangular or other geometric construction, which overcomes the keystoning drawbacks of the prior art by providing an outer sheath which can naturally extend and compress in a longitudinal direction when bent around a corner or around a curved surface.

More specifically, the improved packing material 10 comprises an elongate cordlike construction having an inner core generally indicated at 12 and an outer sheath generally indicated at 14. The inner core 12 can comprise a variety of different types and constructions of varying material including bundles of straight yarns, knit bundles of yarns, knit or braided cords, etc. The particular types of yarns utilized in the core 12 can vary according to use of the packing. In the present embodiment, the inner core 12 preferably comprises a bundle of longitudinally oriented yarns. The outer sheath 14 is preferably either knit or braided around the core 12 in a tubular configuration. The tubular construction of the sheath 14 is formed using both base yarns and "filler" yarns as known in the art. Typically, the sheath 14 is constructed from base yarns comprises yarn compositions which are typically used to form packing materials, such as Teflon, glass, Kevlar, graphite, etc. As will be further described herein, it is known in both braiding and knitting techniques to insert "filler" yarns within the construction to achieve certain desired characteristics to the cords. In the braiding art, such yarns are typically referred to as "filler" yarns, and in the warp-knitting art, the yarns are typically referred to as "interlace or inlaid" yarns. To simplify further discussion of the sheath construction, it is to be understood by the reader that the term "filler" yarn will be used interchangeably with respect to both knitting and braiding techniques, and that the term "filler" is intended to cover either an interlace yarn in knitting or a filler yarn in braiding.

The sheath 14 is preferably knit using a circular warp-knit method, and in conjunction with the drawings, FIGS. 1 and 2 illustrate a circular warp-knit outer sheath. The term "circular warp-knit"as its name implies, refers to a tubular warp-knit fabric which is formed by supplying a number of individual yarns to the needles of a circular knitting machine, and then knitting with all of the needles at the same time to produce a complete course at once. For the sake of clarity and illustration, the circular warp-knit materials illustrated in the drawing figures are shown in a simplified fashion, and specifically with fewer yarns than would be utilized in a preferred commercial product. It will be understood that the principles of circular warp knitting can be completely understood with respect to the drawing figures and that more complex drawings with larger numbers of yarns would be more confusing rather than more illustrative.

Figure 5:
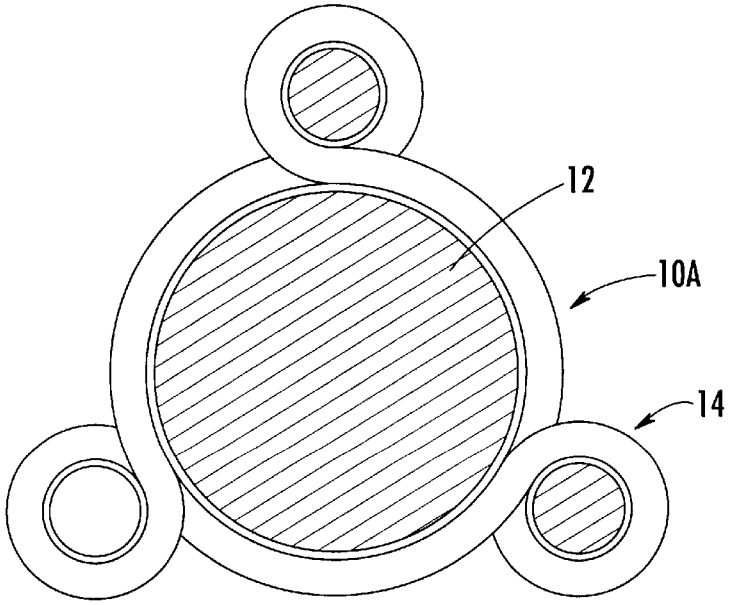
FIG. 5 is a cross-sectional view of a triangular packing material including three filler yarns.

The circular warp-knit sheath 14 is generally knit from a plurality of base yarns B-1 through B-4, each comprising a yarn composition which would be typically used to form a packing material, such as Teflon, glass, Kevlar, graphite coated yarns, etc. (Teflon and Kevlar are registered trademarks of E.I. Du Pont De Nemours and Company). Shading has been added to the yarns B-1 through B-4 to help distinguish each from the other in the drawings. The present circular warp-knit tube 12 has four wales, indicated at W-1 through W-4 circumferentially spaced around the tube 12. The base yarn needle loops form successive courses illustrated C-1 through C-7. The separate base yarns each form base yarn needle loops in corresponding wales W-1 through W-4 of course C-1 and form circular and diagonally extending laps generally indicated L-1 through L-4 extending between and interconnecting the circumferentially spaced wales of the course C-1 with opposite needle loops positioned in the opposite wales in the next successive course. Generally speaking, circular warp-knitting and the automatic knitting machines utilized for rapid warp-knitting of tubular structures as illustrated herein are well known in the art. In this regard, warp-knitting machines and specific knitting procedures which may be utilized for producing a circular warp-knit tube of the type referred to herein are further disclosed in detail in co-owned U.S. Patents to Jencks and Jencks et al U.S. Pat. Nos. 4,838,043, 4,977,759, 5,512,709 and 5,603,514, each of which is entirely incorporated herein by reference. The circular warp-knit sheath 14 is by the nature of its construction substantially free of torque bias that would otherwise inhibit free movement and bending of the structure. Accordingly, the circular warp-knit sheath has a natural ability to conform to curved and other irregular surfaces. The warp-knit sheath 14 is further knit with a plurality of interlaced filler yarns I-1 through I-4 which are respectively interlaced within the wales W-1 through W-4 of the structure 10. The interlace yarns I-1 through I-4 extend generally longitudinally in a zig-zag path along the corresponding wales W-1 through W-4 and are generally utilized to control the longitudinal stability of the circular warp-knit tube. The filler yarns of the circular warp-knit are selectively positioned at predetermined locations within the knit so as to give the sheath a predetermined geometric configuration when knitted. In a preferred construction of 4, 8, 12, 16, 20, 24 knitting needles, four filler yarns are arranged in a symmetrical square configuration to give the packing material a generally square configuration. However, it is noted that movement of the four fillers to non-symmetrical locations in the knit would provide the sheath with other configurations, such as rectangular or trapezoidal. Similarly, the provision of only three fillers would provide the sheath 14 with triangular configurations (See FIG. 5).

The key feature of the present invention is that the interlaced filler yarns I-1 through I-4 comprise yarns or yarn constructions which are extendible and compressible in a longitudinal direction, i.e. any type of yarn or yarn construction which naturally has the ability to extend or compress in a longitudinal direction. Typically natural fiber yarns will have some inherent ability to extend and compress compared to synthetic type yarns, such as glass, or synthetic polymer yarns. However, more preferably the filler yarns comprise a chain-stitched knit yarn construction which is naturally extendible and compressible in a longitudinal direction. When a chain-stitched knit construction is formed, the individual yarns utilized to form the stitch may comprise non-extendible yarns, such as those commonly used in packings since the natural form of the knit construction provides the ability for the entire construction to extend and compress longitudinally. The previously knit filler yarns I-1 through I-4 are laced into the warp in partially extended condition, i.e. under back tension, and will thereafter be at least partially compressible and extendible in a longitudinal direction in the finished circular warp-knit packing material.

The filler yarns I-1 through I-4 may alternately comprise other types of yarn constructions, such as braided, twisted, and plied yarn constructions, which also have some natural ability to extend and compress in a longitudinal direction. Still further, it is contemplated that the filler yarns might comprise a length of coiled wire or synthetic polymer monofilament, or even further an elastic line, each of which would be introduced into the structure under back tension in a partially extended condition. One distinct advantage of a coiled wire type filler yarn is that the coiled structure provides added interior space within the packing for receiving lubricating materials such as Teflon, which are often imbedded into the packing material prior to use.

In use, a length of the packing 10 is formed into a ring, and wrapped around a shaft 16 (FIG. 3). In the finished product, the warp-knit sheath 14 is at least partially longitudinally compressible along an inner radius when the packing material 10 is bent around the curved outer surface of the shaft 16. More specifically, the previously knit filler yarn constructions I-1 and I-4 on the inner radius of the bend will collapse into themselves to form a smooth inner radius rather than bunching up while the knit filler yarn constructions I-2 and I-3 on the outer radius of the bend will extend to accommodate the increased length. The resulting effect of the compression along the inner radius and extension on the outer radius is a reduction of "keystoning" of the packing material.

Figure 4:
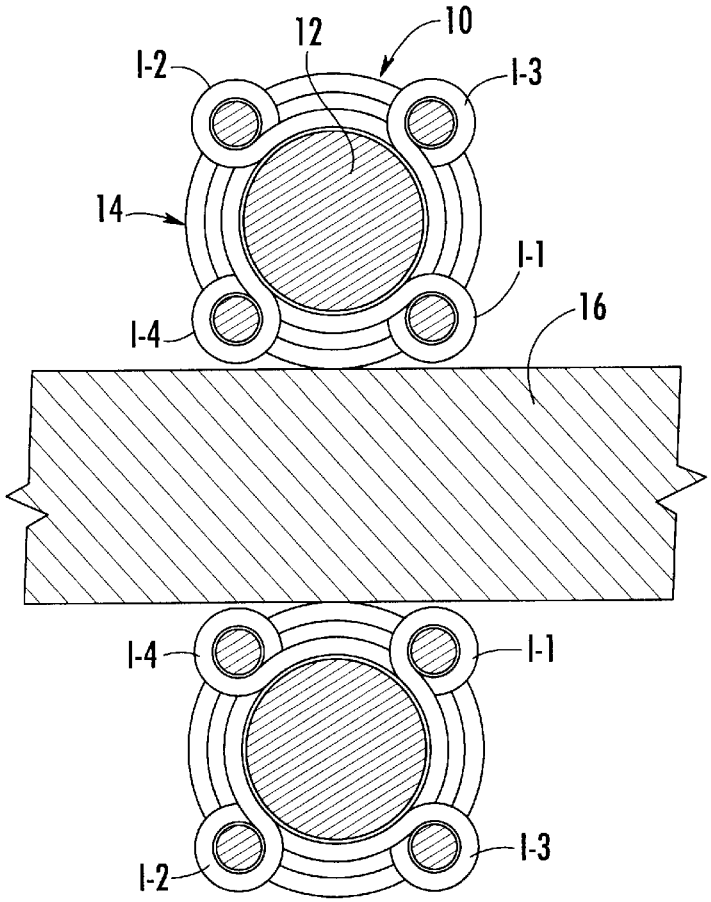
FIG. 4 is a fragmented cross-sectional view taken along line 4—4 of FIG. 3.

Referring to FIG. 4, although it is preferred to utilize the previously knit filler yarns on all corners of the packing, it is to be understood that the filler yarns are really only required on the inwardly facing corners because keystoning is only a significant problem on the inner radius of a packing ring. Accordingly, in a triangular packing, only two of the three corner would need to comprise the compressible yarns.

Although the use of previously knit interlaced filler yarns has been specifically described in connection with warp-knitting techniques, it is to be understood that the concept of using previously knit yarns in packings can also be applied as corner or post fillers to a braided sheath for a packing and packings formed according to other knitting techniques as well. The resulting sheath structures will have the same extension and compression characteristics as the warp-knit structure.

It can therefore be seen that the instant invention provides an improved packing material which significantly reduces keystoning of the packing material when wrapped around corners or curved surfaces. The use of a circular warp-knit sheath which has the natural ability to conform to curved surfaces, along with the use of previously knit interlaced filler yarns which can expand and contract to accommodate different radii when bent around corners significantly reduces the incidence of keystoning of the packing material. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A packing material comprising:

an inner core; and an outer sheath covering said inner core, said outer sheath comprising a circular warp-knitted tube knitted from a plurality of base yarns and a plurality of interlace yarns, said interlace yarns being positioned at predetermined locations within the knit and configured in their circumferential location so as to give said outer sheath a predetermined geometric configuration when viewed in cross section, said interlace yarns each comprising a yarn construction that is compressible and extendible in a longitudinal direction, said yarn construction comprising a previously fashioned yarn construction selected from the group consisting of: knit yarn constructions, braided yarn constructions, twisted yarn constructions, plied yarn constructions, and combinations thereof, said previously fashioned yarn construction allowing said outer sheath to be at least partially longitudinally compressible along an inner radius when said packing material is bent around a curved surface, said longitudinal compression along the inner radius being effective for reducing keystoning of the packing material in use thereof.

2. The packing material of claim 1 wherein there are four filler yarns and said four filler yarns are arranged in a quadrilateral configuration thereby giving the packing material a quadrilateral configuration.

3. The packing material of claim 1 wherein there are three filler yarns and said three filler yarns are arranged in a triangular configuration thereby giving the packing material a triangular configuration.

4. The packaging material of claim 1 wherein said yarn construction comprises a chain stitch knit yarn construction.

* * * * *